United States Patent [19]

Schwing et al.

[11] Patent Number: 4,620,883

[45] Date of Patent: Nov. 4, 1986

[54] FLUIDIZED-BED HEAT-TREATMENT METHOD FOR METALLIC WORKPIECES

[76] Inventors: Ewald Schwing, Wiesfurthstr. 99, 4133 Neukirchen-Vluyn; Peter Sommer, Johann-Strauss-Str. 13, 4174 Issum; Horst Uhrner, Schumannstr. 9, 4174 Issum 2, all of Fed. Rep. of Germany

[21] Appl. No.: 647,139

[22] Filed: Sep. 4, 1984

[30] Foreign Application Priority Data

Sep. 1, 1983 [DE] Fed. Rep. of Germany ..... 3331574

[51] Int. Cl.[4] ..... C21D 1/53

[52] U.S. Cl. ..... 148/13; 148/16; 148/20.3; 148/128

[58] Field of Search ..... 148/128, 16, 13, 13.1, 148/20.3, 16.7, 16.5, 16.6

[56] References Cited

U.S. PATENT DOCUMENTS 3,197,346 7/1965 Munday ..... 148/20.3
4,410,373 10/1983 Kemp ..... 148/16

OTHER PUBLICATIONS

Staffin, H. K., et al, "Continuous Wire Oil Tempering in a Fluidized Bed Furnace", Conference Proceedings, Wire Association, pp. 21–38, May, 1981.

Article, "Wärmebehandlung von metallischen Werkstotten . . . " (Sommer, *Fachberichte Huttenpraxis Metallverarbeitung*, vol. 9/81).

"Einsatz von Wirbelschichten als Abkühlmedium" (Sommer, ZwF 77, vol. 9/82).

*Primary Examiner*—Christopher W. Brody

*Attorney, Agent, or Firm*—Karl F. Ross; Herbert Dubno

[57] ABSTRACT

A metallic object is heat treated by suspending it in a fluidizable bed through which a gas can be passed at a volume/time rate to fluidize it. The temperature of the bed is varied in accordance with a temperature curve having regions of considerable slope and temperature change and regions of inconsiderable slope and temperature change and the workpiece temperature varies in accordance with the bed temperature principally by heat conduction between the bed and workpiece. Enough gas is passed through the bed at a predetermined relatively high volume/time rate sufficent to fluidize the bed only during the periods corresponding to the regions of considerable slope and gas is passed through the bed at a relatively low volume/time rate equal to more than 0% and less than 75%, and preferably between 5% and 45%, of the high rate and insufficient to fluidize the bed during the periods corresponding to the regions of inconsiderable slope. The low rate is about 10% of the high rate.

5 Claims, 2 Drawing Figures

FLUIDIZED-BED HEAT-TREATMENT METHOD FOR METALLIC WORKPIECES

FIELD OF THE INVENTION

The present invention relates to a fluidized-bed heat-treatment method for a metallic workpiece. More particularly this invention concerns such a method wherein the workpiece is subjected to discrete periods of heating and/or cooling separated by periods in which the workpiece temperature is maintained generally the same.

BACKGROUND OF THE INVENTION

The hardening, nitriding, nitrocarbiding, carbonizing, carbonitriding, and similar processes for metallic objects require that the workpiece be subjected to discrete periods of accurately controlled heating and/or cooling separated by periods during which the workpiece temperature is maintained steady, normally to equalize the temperature throughout the piece. To do this the workpiece is typically supported in a fluidized bed of heat-conducting particles so as to maximize heat exchange, as solid-solid heat exchange is highly efficient and allows accurate control of the process. A gas is fed through the bed at a volume/time rate sufficient to fluidize it and the bed is heated and/or cooled in accordance with the desired effect.

As mentioned above and described in "Warmebehandlung von metallischen Werkstoffen im Wirbelbettofen" (Sommer, *Fachberichte Huttenpraxis Metallverarbeitung,* volume 9/81) and "Einsatz von Wirbelschichten als Kuhlmedium" (also Sommer, ZwF 77, volume 9/82), the periods in which the workpiece temperature is radically changed are separated by periods during which the temperature remains relatively stable or becomes uniform throughout the workpiece. In other words the temperature/time curve of the bed has a first derivative which is considerable different from zero during the heating or cooling periods and which is about zero during the intervening steady-temperature periods.

The bed can be heated by the provision of coils or heating bars right in it for direct heating or outside the bed for indirect heating. Or it can be heated by a burner upstream and normally below the bed, or the burner can be effective against the sides of the vessel containing the bed. The bed is fluidized by a fan which forces enough gas through it to keep it fluid, and heat sensors are provided in or immediately downstream of the bed to ascertain the bed temperature. The heater or cooler is turned on high for the desired radical-heating or -cooling phases and is turned down for steady-temperature phases.

Such an arrangement can accurately heat treat a workpiece to produce a desired crystalline structure, but uses a great deal of energy. When the gas used to fluidize the bed is at a temperature that is quite a bit different from that the workpiece is to have, as in systems with a heating/cooling coil in the bed underneath the workpiece, the cooling or heating effect of this current of air must be compensated for by the heater or cooler. Even when the gas stream used for fluidizing is itself heated or cooled upstream of the bed so that it in turn heats the bed and the workpiece, it is necessary to heat or cool a much larger supply of gas than is actually necessary to heat or cool the workpiece. The gas exiting from the top of the bed during steady-state operation, for example, is virtually at the treatment temperature, representing a substantial expenditure of energy, and also requiring close monitoring and control of the process even during such steady-state operation.

OBJECT OF THE INVENTION

It is therefore an object of the present invention to provide an improved heat-treatment method and system.

Another object is the provision of such a heat-treatment method and system which overcome the above-given disadvantages, that is which operate simply and efficiently.

A further object is to reduce the volume of gas needed in such a process, which volume is defined by the integral of the volume/time curve.

SUMMARY OF THE INVENTION

A metallic object is heat treated (which term is intended of course to cover both negative and positive temperature change) in accordance with the standard method by suspending it in a fluidizable bed through which a gas is passed at a volume/time rate to fluidize it. The temperature of the bed is varied in accordance with a temperature curve having regions of considerable slope and temperature change and regions of inconsiderable slope and temperature change and the workpiece temperature varies in accordance with the bed temperature principally by heat conduction between the bed and workpiece. The method according to this invention comprises the steps of passing enough gas through the bed at a predetermined relatively high volume/time rate sufficient to fluidize the bed only during the periods corresponding to the regions of considerable slope and passing gas through the bed at a relatively low volume/time rate equal to more than 0% and less than 75%, and preferably between 5% and 45%, of the high rate and insufficient to fluidize the bed during the periods corresponding to the regions of inconsiderable slope.

According to this invention the low rate is about 10% of the high rate. The periods of radical temperature change correspond to a steep slope of the temperature curve, which in turn corresponds to the first derivative with respect to time of this curve, and normally represent a temperature change rate of between 4° C./min and 8° C./min. The periods of relatively steady temperature correspond to a first derivative of the curve during the period in question of about zero, normally representing a temperature change rate of between 0.1° C./min and 0.5° C./min.

To carry out this method the temperature is detected generally in, that is within or near to, the bed and the gas-flow rate is varied in accordance with the detected temperature. This detected temperature is compared with a desired-value temperature of between 1° C. and 1200° C., which desired-value temperature in turn is determined by the time-dependent heat-treatment curve for the particular workpiece. It is also possible to measure the temperature of the heater/cooler, or simply of the wall of the vessel containing the bed.

In the prior-art systems the volume/time rate of the gas flow is fixed, normally at the minimum possible level to fluidize the bed. Thus the size and makeup of the bed determine this flow rate. The amount of gas actually needed for the heat exchange is substantially less due to the excellent heat exchange between the solid particles and the solid workpiece. According to this invention, however, gas flow is cut substantially during the steady-state times so that the bed settles down. It has been discovered that the gas passes through the bed during these times sufficiently to maintain the desired temperature even with the limited heat-exchange efficiency between the quiescent nonfluidized bed and the workpiece imbedded in it. When the particular metal's heat-treatment curve requires that the workpiece temperature again be radically increased or decreased, the high flow rate, which is normally the minimum necessary to fluidize the bed, is reverted to, fluidizing the bed and increasing heat-exchange efficiency. Since normally only between one-tenth and one-fifteenth of the overall treatment time is taken by the periods of radical temperature change, the remaining nine-tenths to fourteen-fifteenths being taken by the periods of steady temperature, the reduction in gas consumption is considerable. The result is extremely efficient operation, greatly reducing the production costs of such normally expensive heat-treated products.

The apparatus according to this invention has a vessel that holds a fluidizable bed and a workpiece to be treated in the bed and a pump or fan that passes a gas stream through the bed at a sufficiently high volume/flow rate to fluidize the bed and at a lower volume/flow rate equal to at most 75% of the high rate and insufficient to fluidize the bed. A heater/cooler varies the temperature of the bed. Thus the workpiece exchanges heat with the bed by conduction. A sensor at least generally in the bed detects the instantaneous temperature of the bed. A differentiator connected to the sensor feeds the absolute value of the differential quotient of the detected temperature with respect to time to the actual-value input of a comparator also receiving a desired value corresponding to a temperature of between 0° C. and 1200° C. The comparator output carries the difference between the desired value and the differential quotient. A circuit connected to the output and to the pump switches same from the low rate to the high rate when the difference deviates positively and switches the pump from the high rate to the low rate when the difference is about zero and when it is negative.

Thus the system of this invention effectively has two different levels of control. During those portions of the treatment time when the workpiece temperature is to be changed relatively rapidly, the pump is used to fluidize the bed. During the remaining portions of the treatment time the pump is operated at the lower rate. At all times the heating or cooling effective of the heater/cooler is varied in accordance with the instantaneous temperature of the bed and the desired temperature. The slope or differential of the temperature curve of the particular workpiece for the treatment period in progress is employed to determine whether to switch over the pump or not.

DESCRIPTION OF THE DRAWING

The above and other features and advantages will become more readily apparent from the following, reference being made to the accompanying drawing in which.

SPECIFIC DESCRIPTION

Figure 1:
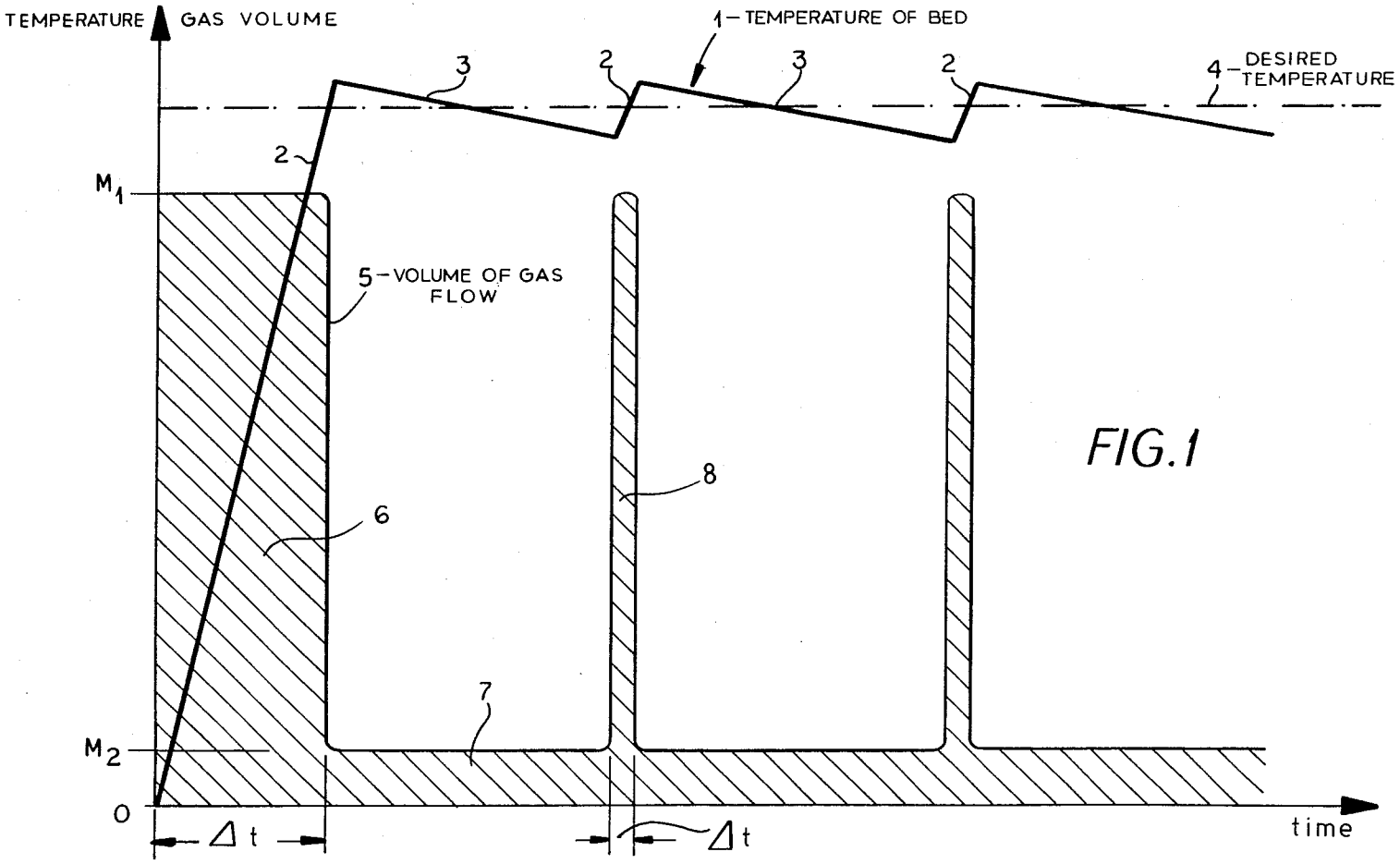
FIG. 1. is a diagram illustrating the method of this invention.

The abscissa in FIG. 1 represents the passage of time during the treatment and the ordinate shows both the temperature and the gas volume. The curve 1 represents the variation of workpiece temperature with respect to time, having steep portions 2 corresponding to periods of radical temperature increase and relatively flat portions 3 corresponding to periods of generally steady temperature. The dot-dash line 4 parallel to the abscissa represents the desired temperature.

Figure 2:
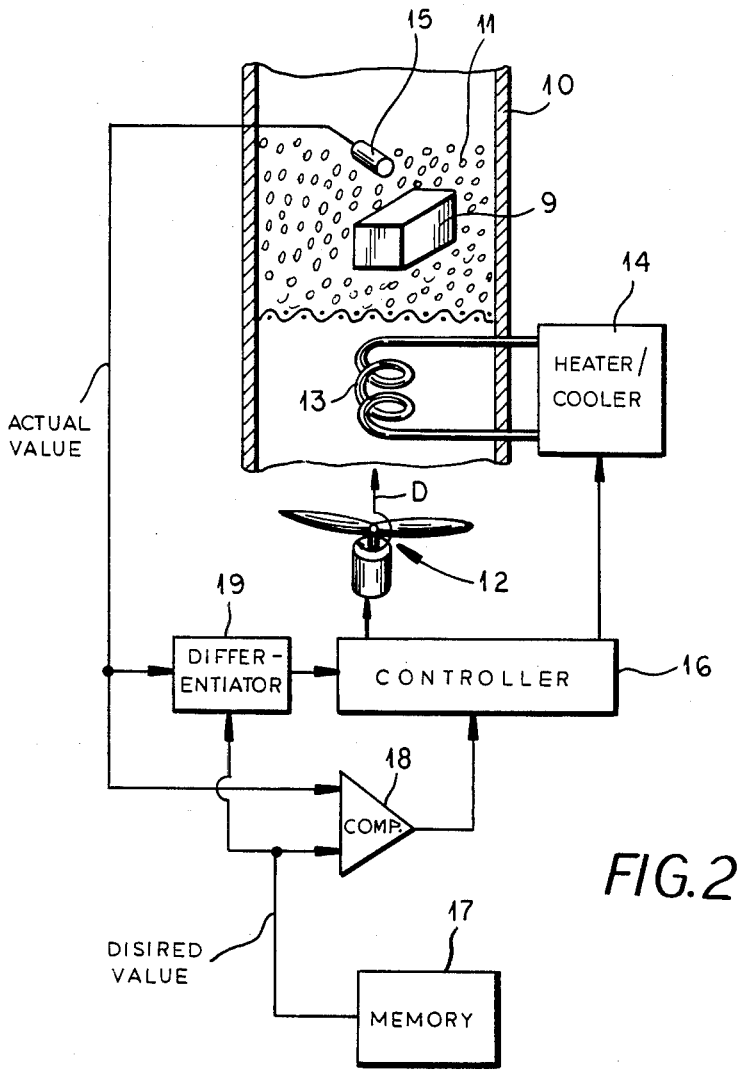
FIG. 2 is a schematic view of the system for carrying out the method of the invention.

FIG. 2 shows a workpiece 9 held in a vessel 10 in a bed 11 of particles. A fan 12 can create a current of air passing upward as indicated by arrow D through the bed 11, and a heat-exchange coil 13 of a heater cooler 14 is provided either in the bed 11 or slightly upstream in the gas-flow direction D therefrom. A temperature sensor 15 is provided in the vessel 10 downstream of the workpiece 9.

Under normal circumstances a controller 16 at least indirectly connected to the sensor 15 operates the heater/cooler 14 to keep the bed and workpiece temperature generally at the desired temperature shown by dot-dash line 4.

According to this invention and as further shown in FIG. 1, the fan or pump 12 is operable at a relatively high flow rate $M_1$ sufficient to fluidize the bed 11 and at a relatively low rate $M_2$ which here represents about 10% of the rate $M_1$, and which is insufficient to fluidize the bed 10. The low flow rate $M_2$ serves principally to equalize heat in the bed 11 and workpiece 9 and to make the sensor 15 give an accurate reading.

A memory 17 holds the temperature curve 1 for the particular workpiece 9 and feeds it to one input of a comparator 18 whose output is connected to the controller 16, and also is connected to a differentiator 19 for the actual bed and workpiece temperature. The controller 16 therefore switches the fan 12 between the high and low rates by determining the slope of the curve 1 and operating the fan 12 in accordance with the curve 5 of FIG. 1. During the time periods t that correspond to the curve portions 2 the fan 12 is operated at the high rate $M_1$ and during the intervening periods corresponding to the curve portions 3 at the low rate $M_2$. The curve 5 therefore has regions 6 and 8 of high flow rate and regions 7 of low flow rate. The hatched area under the curve 5 that is the integral of this curve represents the total volume of gas used by the system.

Obviously the overall amount of gas used is a small fraction of that used by a standard prior-art system which operates continuously at the high rate $M_1$, a procedure that consumes considerable energy even when the workpiece temperature does not need to change.

We claim:

1. A method of heat treating a metallic object suspended in a fluidizable bed, the method comprising the step of:

initially flowing a heated gas through the bed at a volume/time flow rate sufficiently high to fluidize the bed and for a time sufficient to raise the temperature of the object generally to a high treatment temperature lying between 1° C. and 1200° C.;

thereafter flowing the heating gas through the bed at a relatively low volume/time rate equal as most to 75% of the high rate and insufficient both to fluidize the bed and to prevent the object from cooling; and thereafter maintaining the temperature of the object generally at the high treatment temperature by alternately heating the workpiece with high-rate flow and cooling with low-rate flow and thereby only intermittently fluidizing the bed.

2. The heat treatment method defined in claim 1, further comprising the step of detecting the temperature generally in the bed and varying the gas-flow rate in accordance therewith.

3. The heat treatment method defined in claim 2, further comprising the step of comparing the detected temperature with a desired-value temperature of between 1° C. and 1200° C. and regulating the gas-flow rate in accordance with the difference therebetween.

4. The heat treatment method defined in claim 1 wherein the low rate is about 10% of the high rate which is the rate just sufficient to fluidize the bed.

5. The heat treatment method defined in claim 1 wherein the low rate is between 5% and 45% of the high rate.

* * * * *